US006450177B1

(12) United States Patent
Christoforu et al.

(10) Patent No.: US 6,450,177 B1
(45) **Date of Patent: *Sep. 17, 2002**

(54) APPLICATOR BRUSH

(75) Inventors: Andrew Christoforu, Monsey, NY (US); Kristi E. Simonelli, Roselle; Tameru Getahoun, Hackensack, both of NJ (US)

(73) Assignee: Avon Products, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/441,355

(22) Filed: Nov. 16, 1999

Related U.S. Application Data

(63) Continuation-in-part of application No. 09/267,959, filed on Mar. 12, 1999, now Pat. No. 6,016,815.

(51) Int. Cl.[7] ..... A45D 40/26
(52) U.S. Cl. ..... 132/218
(58) Field of Search ..... 132/218, 313, 132/317; 401/129

(56) References Cited

U.S. PATENT DOCUMENTS

| | | | |
|---|---|---|---|
| 1,337,819 | A | 4/1920 | Braun |
| 2,433,325 | A | 12/1947 | Slaughter |
| 2,508,799 | A | 5/1950 | Reis, Jr. |
| 2,580,378 | A | 12/1951 | Peterson et al. |
| 2,627,621 | A | 2/1953 | Bardugon |
| 2,637,893 | A | 5/1953 | Shaw |
| 3,121,040 | A | 2/1964 | Shaw et al. |
| 3,124,823 | A | 3/1964 | Charvat |
| 3,186,018 | A | 6/1965 | Shaw |
| 3,214,782 | A | 11/1965 | Masters et al. |
| 3,233,944 | A | 2/1966 | Shaw |
| 3,238,553 | A | 3/1966 | Bailey et al. |
| 3,344,457 | A | 10/1967 | Grobert |
| 3,582,140 | A | 6/1971 | Kaufman et al. |
| 3,908,676 | A | 9/1975 | Levine et al. |

(List continued on next page.)

FOREIGN PATENT DOCUMENTS

| | | |
|---|---|---|
| CA | 1 194 263 | 10/1985 |
| CA | 2 022 205 | 2/1991 |
| CA | 2 076 600 | 2/1993 |
| CA | 2 102 399 | 4/1993 |
| CA | 2 107 069 | 3/1994 |
| CA | 2 103 081 | 5/1994 |
| CA | 2 030 405 | 4/1996 |
| CA | 2 064 659 | 5/1997 |
| DE | 1140901 | 12/1962 |
| DE | 1 205 051 | 11/1965 |

(List continued on next page.)

OTHER PUBLICATIONS

DuPont TYNEX Filaments brochure, DuPont Filaments, Washington WV, 8 pp, Dec. 1997.*

Attached excerpt from Henlopen Brochure, publication date prior to Oct. 2, 1998.

*Primary Examiner*—Todd E. Manahan
(74) *Attorney, Agent, or Firm*—Ohlandt, Greeley, Ruggiero & Perle, LLP

(57) ABSTRACT

An applicator or brush having a twisted wire core and a bristle portion that has a square cross-section. The brush portion is formed from a plurality of plastic filaments. Each plastic filament is crimped medially of its ends by the wire core. The crimping action causes the filament ends to form bristle ends that flare outwardly in various directions from the wire core so as to provides a uniform bristle end distribution throughout the bristle portion. The filament density is about 45 to 60 filaments per helical turn. Each filament has a hollow central core from which two or more bent flanges extend. The area along the central core between adjacent flanges holds mascara by surface tension.

19 Claims, 3 Drawing Sheets

U.S. PATENT DOCUMENTS

| | | | | | |
|---|---|---|---|---|---|
| 3,921,650 | A | | 11/1975 | Montgomery | |
| 4,381,325 | A | | 4/1983 | Masuda et al. | |
| 4,387,479 | A | | 6/1983 | Kigyos | |
| 4,403,624 | A | | 9/1983 | Montgomery | |
| 4,446,880 | A | | 5/1984 | Gueret et al. | |
| 4,461,312 | A | | 7/1984 | Gueret | |
| 4,470,425 | A | | 9/1984 | Gueret | |
| 4,545,393 | A | | 10/1985 | Gueret et al. | |
| 4,559,268 | A | | 12/1985 | Nakashima et al. | |
| 4,561,456 | A | | 12/1985 | Gueret | |
| 4,617,948 | A | | 10/1986 | Guéret | |
| 4,632,136 | A | | 12/1986 | Kingsford | |
| 4,662,385 | A | | 5/1987 | Schefer | |
| 4,733,425 | A | | 3/1988 | Hartel et al. | |
| 4,861,179 | A | | 8/1989 | Schrepf et al. | |
| 4,887,622 | A | | 12/1989 | Gueret | |
| 4,927,281 | A | * | 5/1990 | Gueret | 132/218 |
| 4,974,612 | A | | 12/1990 | Gueret | |
| 4,993,440 | A | | 2/1991 | Gueret | |
| 5,063,947 | A | | 11/1991 | Gueret | |
| 5,357,987 | A | * | 10/1994 | Schrepf | 132/218 |
| 5,482,059 | A | * | 1/1996 | Miraglia | 132/218 |
| 5,551,456 | A | * | 9/1996 | Hartel | 132/218 |
| 5,567,072 | A | * | 10/1996 | Dunleavy et al. | 132/218 |
| 5,876,138 | A | | 3/1999 | Gueret | |
| 6,012,465 | A | * | 1/2000 | Gueret | 132/218 |

FOREIGN PATENT DOCUMENTS

| | | |
|---|---|---|
| GB | 685054 | 12/1952 |
| GB | 1351057 | 4/1974 |
| GB | 2146520 | 4/1985 |
| GB | 2170996 | 8/1986 |
| GB | 2198337 | 6/1988 |
| JP | 50-37221 | 4/1975 |
| JP | 56-37907 | 4/1981 |
| JP | 59-1312 | 1/1984 |
| JP | 61-106781 | 5/1986 |

* cited by examiner

APPLICATOR BRUSH

RELATED APPLICATION

This application is a continuation-in-part of application, Ser. No. 09/267,959, filed Mar. 12, 1999, U.S. Pat. No. 6,016,815 entitled Applicator Brush and assigned to the same assignee as this application.

BACKGROUND OF INVENTION

1. Field of the Invention

The present invention relates to a cosmetic applicator and, in particular, to an applicator for applying liquid cosmetics, such as mascara, to eyelashes or other parts of the body.

The general purpose of an applicator or brush is to pick up an adequate supply of material, such as mascara, from a container, carry it from the reservoir of the container without dripping, and apply it evenly to the particular area of the body, such as, for example, eyelashes. This needs to be achieved without depositing lumps or blobs of the material on the eyelashes.

To do so, it is important that the bristle ends of the applicator have a distribution that permits the pick up of an adequate supply of material and retains it until it is applied to the eyelashes. It is also important that the filaments that form the bristle ends have sufficient structural strength to comb the material or mascara through the eyelashes.

A conventional mascara brush has a twisted wire core, and a bristle portion. The bristle portion has a plurality of plastic filaments. Each plastic filament is gripped by the twisted wire medially of its ends to form bristle ends.

2. Description of the Prior Art

U.S. Pat. No. 4,887,622 to Gueret is directed to a brush of this type in which the bristle ends extend radially from the core as a helical array and are disposed in a manner to avoid interference of the bristle ends of one turn with the bristle ends of adjacent turns. Each filament has a diameter from 0.10 to 0.25 mm. The number of filaments per helical turn of the twisted wire core is approximately 10 to 40.

U.S. Pat. No. 4,993,440 to Gueret is also directed to a mascara brush that has a twisted wire core, and a bristle portion. The bristle portion has a plurality of plastic filaments. Each plastic filament is gripped by the twisted wire medially of its ends to form bristle ends. This patent also provides that each filament has one or more U or V shaped capillary channels formed in its surface. The sides of the U or V shaped capillary channel converge slightly toward each other near their free ends before again diverging outward to a zone where the channel opens out at the surface of the filament. The bristle ends are disposed to extend radially from the wire core, and are distributed to avoid interference of the bristle ends of one turn with the bristle ends of adjacent turns.

U.S. Pat. No. 4,733,425 to Hartel, et al. is directed to a brush of the type described above in U.S. Pat. No. 4,887,622. In this Hartel patent, the plastic filament bristle ends flare outwardly in various directions when gripped by the twisted wire. This outward flaring forms a bristle end distribution pattern that is uniform at the bristle face. The filament is described as a hollow or tubular polyamide, or one that has a non-circular cross section.

SUMMARY OF INVENTION

It is an object of the present invention to provide an improved applicator that picks up an adequate supply of the liquid and applies it evenly without lumping.

It is another object of the present invention to provide such an improved applicator that is used as a mascara applicator or brush to apply a liquid cosmetic, such as mascara.

It is a further object of the present invention to provide such an improved applicator that has a uniform distribution of the bristle ends throughout, and a filament density of approximately 45 to approximately 60 filaments per helical turn.

These and other objects of the present invention will be achieved by an applicator according to the present invention that has a core of twisted wire that forms a plurality of helical turns. The applicator includes a bristle portion that is formed of a plurality of filaments with each filament being crimped medially of its ends by the wire core. The ends of the crimped filament form bristles or bristle ends that flare outwardly in various directions from the core. This flaring forms a uniform distribution of the bristle ends throughout the bristle portion. The filament density in the bristle portion is approximately 45 to approximately 60 filaments per helical turn.

Each filament has a central core with at least two spaced apart radially extending flanges. In some embodiments, at least one of the flanges is bent. In other embodiments, at least one of the flanges radially extends from the central core in a nonlinear manner. Preferably, the central core is hollow. The area along the central core between adjacent flanges holds mascara by surface tension.

In one preferred embodiment, the bristle portion of the brush has a generally square cross section. At the free end of the brush, the bristle portion tapers to a circular cross section.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF THE INVENTION

Figure 1:
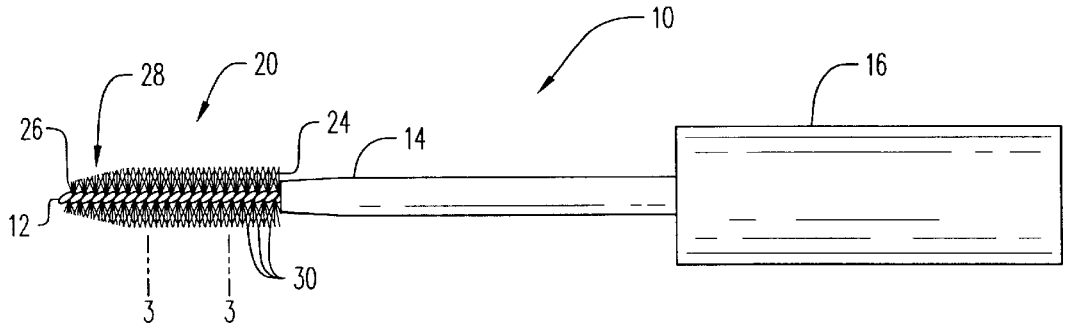
FIG. 1 is a side elevation view of an applicator according to the present invention.

Referring to the drawings and, in particular, FIG. 1, there is provided an applicator or brush according to the present invention, generally represented by reference numeral 10. The applicator 10 has a core 12, a rod 14, a cap 16 and a bristle portion 20.

The core 12 is formed from a U-shaped length of wire that is twisted about itself. The wire for wire core 12 is preferably a metallic wire.

Rod 14 covers a portion of wire core 12 that extends to the right of bristle portion 20. Rod 14 is secured to this portion of wire core 12 by a suitable fastener, such as by coining and heat sealing. Rod 14 extends into cap 16 and is suitably secured to the cap by conventional means.

Figure 2:
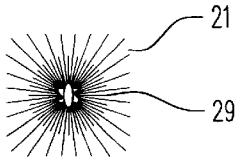
FIG. 2 is an end view of the applicator of FIG. 1.
Figure 3:
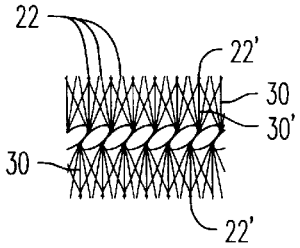
FIG. 3 is an exploded view of the section defined by lines 3 of the applicator of FIG. 1.

Referring to FIGS. 1 and 3, bristle portion 20 is formed of a plurality of filaments 30. Bristle portion 20 has a first end 24 towards rod 14, and a second or free distal end 26 opposite the first end. Second end 26 has a taper 28. Basically, bristle portion 20 has a generally uniform and square cross section 21 with taper 28 having a generally circular cross section 29, as shown clearly in FIG. 2. To obtain the square cross section 21, the bristle ends 22 are clipped by conventional cutter means. In the cutting operation, the edges or corners are rounded to give a comfortable application.

Each filament 30 is preferably formed of a plastic filament. Each plastic filament 30 is crimped medially of its ends by wire core 12 whereby its ends form bristle ends 22. For example, bristle ends 22' are formed by a filament 30' crimped by core 12 as shown in FIG. 3. The bristle material and shape is such that the crimping action causes the bristle ends 22' to flare radially outward from core 12 in various directions. The effect of the multidirectional flaring of bristle ends 22 is that they uniformly fill the spaces between adjacent turns of core 12. This gives the effect of a uniform distribution of bristle ends 22 throughout bristle portion 20.

The density of filaments 30 in bristle portion 20 is preferably in the range of about 45 to about 60 filaments per helical turn. A helical turn is one turn of core 12. More preferably, the density is in the range of about 48 to about 60 filaments per turn. Most preferably, the density is in the range of about 45 to about 55 filaments per helical turn. A density in this range has been found to give an even application of mascara without forming lumps of mascara on the eyelashes or on bristle portion 20.

In use, the brush 10 is gripped by the cap 16 and dipped into a reservoir of liquid material, such as mascara. The brush is withdrawn from the reservoir through a narrow orifice by a wiping action to obtain a distribution of mascara on bristle portion 20 suitable for applying to the eyelashes or other hair.

Figure 4:
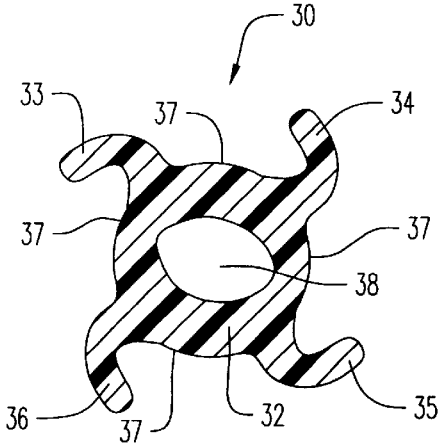
FIG. 4 is a cross sectional view of a filament of the applicator of FIG. 1.

Referring to FIG. 4, each of the plurality of bristles 30 generally has a central core 32 with a bore 38 therethrough, and spaced apart portions or flanges 33, 34, 35 and 36 extending outward from the periphery or exterior surface of the core.

The bore 38 may be a circular bore. Preferably, bore 38 is a generally oblong shaped bore.

The central core 32 has an overall square configuration, except for outwardly extending flange portions 33, 34, 35 and 36. As shown in FIG. 4, flange portions 33, 34, 35 and 36 are formed on what would otherwise be the edge of the square shaped core. It should be understood that although four flanges are shown in FIG. 4, the present invention encompasses embodiments that have two or more such flanges.

Flanges 33, 34, 35 and 36 are bent in the same direction about the periphery of central core 32. The area along the periphery between adjacent pair of flanges 33, 34, 35 and 36 is area 37. Each area 37 holds or retains mascara by surface tension.

The maximum cross sectional dimension of each filament 26, and thus each bristle 30, is about 0.08 to about 0.18 mm. Preferably, the maximum cross sectional dimension is about 0.10 to about 0.15 mm.

The filaments 26 for each pair of bristles 30 shown in FIG. 4 may be obtained commercially from Dupont De Nemours Corporation.

Figure 5:
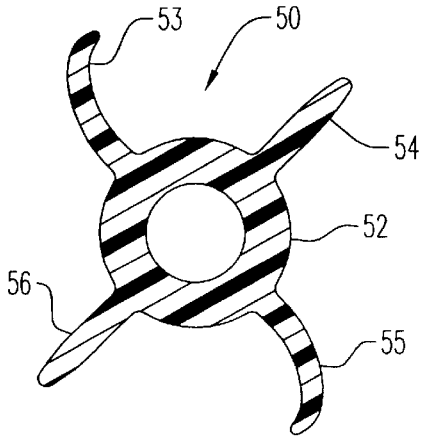
FIGS. 5 through 15 are cross sectional views of alternative filaments for the applicator of FIG. 1.

Referring to FIGS. 5 through 15, a plurality of alternative filaments is provided according to the invention. Referring first to FIG. 5, a filament 50 has a central core 52 with a first pair of approximately identical curled flanges 53 and 55 radially extending in approximately opposite directions. A second pair of approximately identical flanges 54 and 56 also extend from core 52 in opposite directions.

Figure 6:
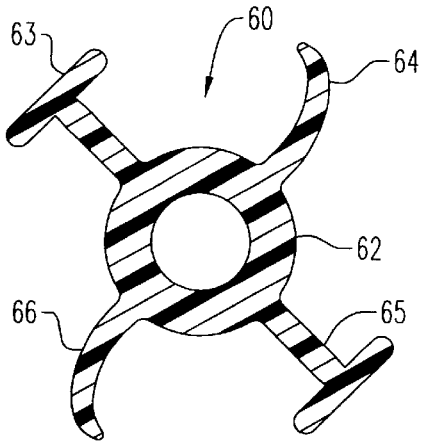

Referring to FIG. 6, a filament 60 has a central core 62 with a first pair of approximately identical curled flanges 64 and 66 radially extending in approximately opposite directions. A second pair of approximately identical T-shaped flanges 63 and 65 also extend from core 62 in opposite directions.

Figure 7:
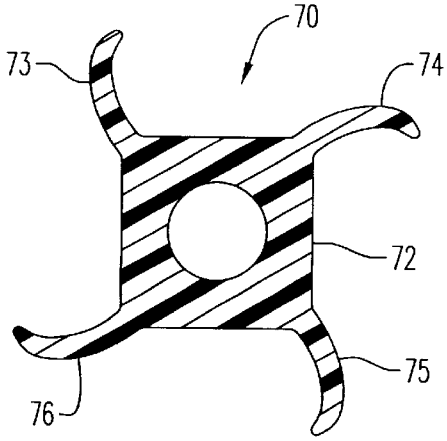

Referring to FIG. 7, a filament 70 has a central core 72 with a first pair of approximately identical curled flanges 74 and 76 radially extending in approximately opposite directions. A second pair of approximately identical curled flanges 73 and 75 also extend from core 72 in opposite directions.

Figure 8:
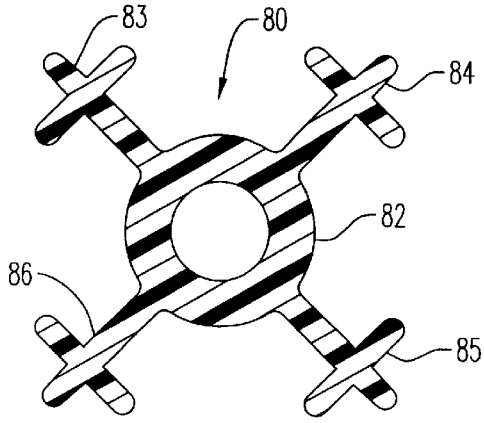

Referring to FIG. 8, a filament 80 has a central core 82 with radially extending cruciform shaped flanges 83, 84, 85 and 86. Flanges 83 and 85 extend from core 82 in approximately opposite directions and flanges 84 and 86 extend from core 82 in approximately opposite directions.

Figure 9:
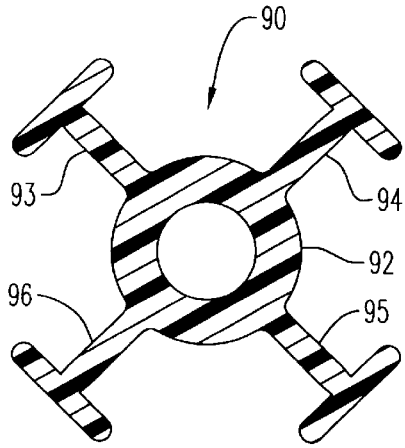

Referring to FIG. 9, a filament 90 has a central core 92 with radially extending T-shaped flanges 93, 94, 95 and 96. Flanges 93 and 95 extend from core 82 in approximately opposite directions and flanges 94 and 96 extend from core 92 in approximately opposite directions.

Figure 10:
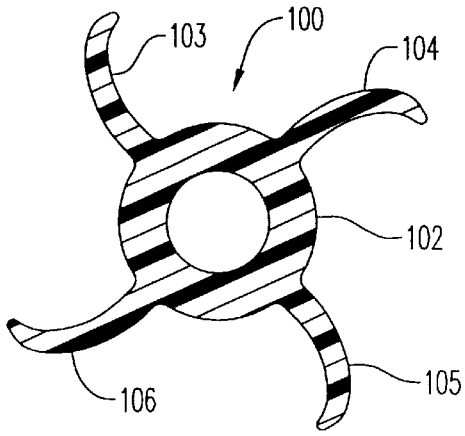

Referring to FIG. 10, a filament 100 has a central core 102 with radially extending curled flanges 103, 104, 105 and 106. Approximately identical flanges 103 and 105 extend from core 102 in approximately opposite directions and approximately identical flanges 104 and 106 extend from core 102 in approximately opposite directions.

Figure 11:
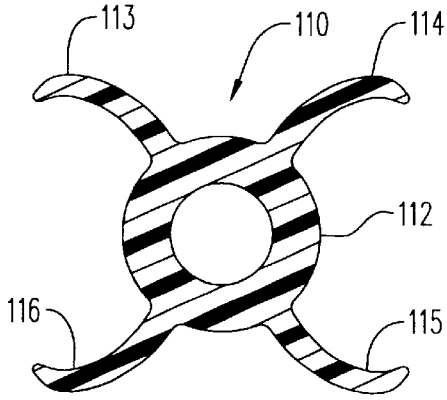

Referring to FIG. 11, a filament 110 has a central core 112 with radially extending curled flanges 113, 114, 115 and 116. Approximately identical flanges 113 and 115 extend from core 112 in approximately opposite directions and approximately identical flanges 114 and 116 extend from core 112 in approximately opposite directions.

Figure 12:
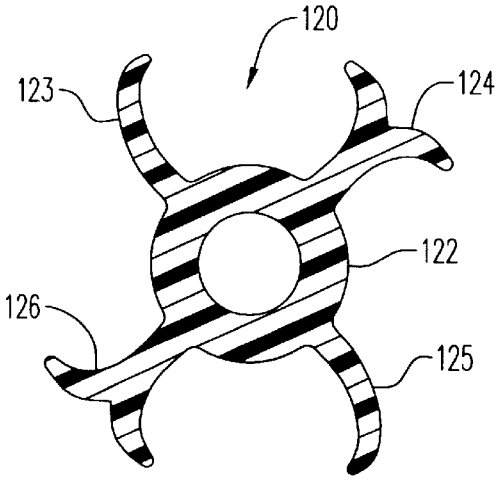

Referring to FIG. 12, a filament 120 has a central core 122 with radially extending flanges 123, 124, 125 and 126. Approximately identical curled flanges 123 and 125 extend from core 122 in approximately opposite directions and approximately identical fishtail shaped flanges 124 and 126 extend from core 122 in approximately opposite directions.

Figure 13:
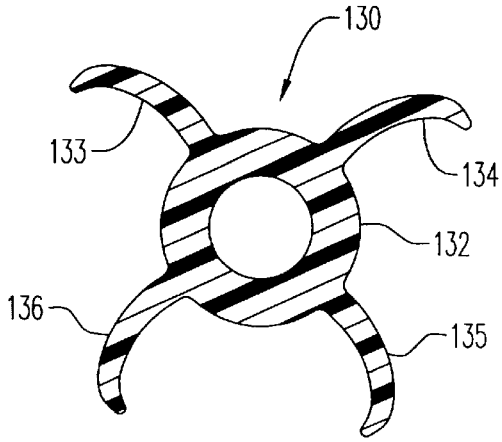

Referring to FIG. 13, a filament 130 has a central core 132 with radially extending curled flanges 133, 134, 135 and 136. Adjacent flanges 135 and 136 curl in opposite directions toward one another. All other adjacent flanges curl in the same direction. For example, adjacent flanges 134 and 135 curl in the same direction.

Figure 14:
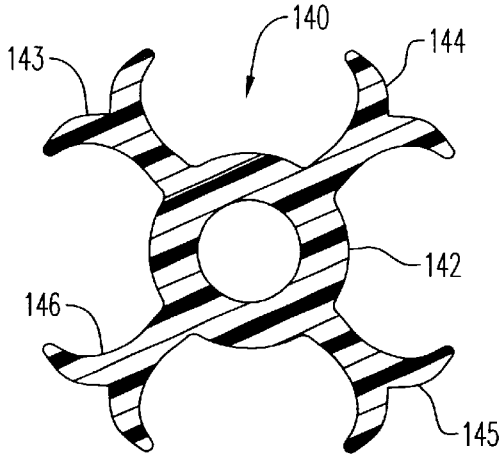

Referring to FIG. 14, a filament 140 has a central core 142 with radially extending fishtail shaped flanges 143, 144, 145 and 146. Approximately identical flanges 143 and 145 extend from core 142 in approximately opposite directions and approximately identical flanges 144 and 146 extend from core 142 in approximately opposite directions.

Figure 15:
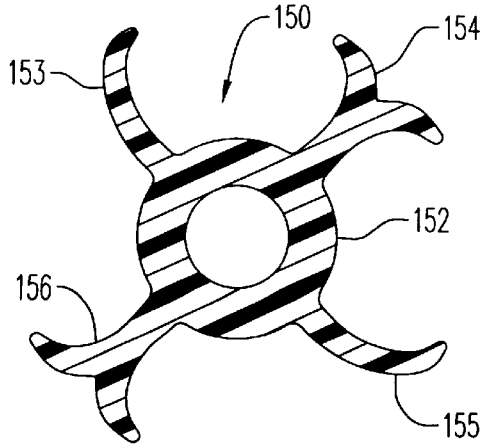

Referring to FIG. 15, a filament 150 has a central core 152 with radially extending flanges 153, 154, 155 and 156. Approximately identical curled flanges 153 and 155 extend from core 152 in approximately opposite directions, and approximately identical fishtail shaped flanges 154 and 156 extend from core 152 in approximately opposite directions. Flanges 153 and 155 curl toward adjacent fishtail shaped flange 154 and curl away from adjacent fishtail shaped flange 156.

Several of the flanges extend non-linearly from their respective central cores. For example, T-shaped flanges 63 and 65, shown in FIG. 6, extend nonlinearly from central core 62 and cruciform flanges 83 through 86, shown in FIG. 8, extend nonlinearly from central core 82.

The present invention having been thus described with particular reference to the preferred forms thereof, it will be obvious that various changes and modifications may be made therein without departing from the spirit and scope of the present invention as defined in the appended claims.

What is claimed is:

1. An applicator for applying liquid material to a portion of one's body, said applicator comprising:

a core twisted together to form a plurality of helical turns;

a bristle portion formed of a plurality of filaments, each of said plurality of filaments being crimped medially by said core to form bristle ends that flare outwardly from said core, wherein said bristle ends form a uniform bristle end distribution throughout said bristle portion, wherein said bristle portion has a filament density of approximately 45 to approximately 60 filaments for each of said plurality of helical turns; and at least some of said plurality of filaments having a central core with a plurality of spaced apart and radially extending flanges, wherein at least one of said plurality of flanges is bent in a direction different from one or more of the other flanges, wherein the central core has a periphery, and wherein said periphery between adjacent flanges holds said liquid material by surface tension.

2. The applicator according to claim 1, wherein said central core is hollow.

3. The applicator according to claim 2, wherein said central core has an oblong hollow shape.

4. The applicator according to claim 2, wherein said bristle portion has a generally square cross section.

5. The applicator according to claim 2, wherein each of said plurality of filaments has a maximum cross sectional dimension of about 0.08 to about 0.18 mm.

6. The applicator according to claim 5, wherein said maximum cross sectional dimension is about 0.10 to 0.15 mm.

7. The applicator according to claim 1, wheerein said bristle portion has a taper at one end.

8. The applicator according to claim 7, wherein said bristle portion has a generally square cross section with said taper having a generally circular cross section.

9. The applicator according to claim 1, wherein said filament density is approximately 48 to approximately 60 filaments for each said helical turn.

10. The applicator according to claim 1, wherein said filament density is approximately 45 to approximately 55 filaments for each said helical turn.

11. The applicator according to claim 1, wherein at least some of said plurality of filaments generally have at least four spaced apart flanges radially extending from said central core.

12. The applicator according to claim 1, wherein said filament is plastic.

13. An applicator for applying liquid material to a portion of one's body, said applicator comprising:

a core twisted together to form a plurality of helical turns;

a bristle portion formed of a plurality of filaments, each of said plurality of filaments being crimped medially by said core to form bristle ends that flare outwardly from said core, wherein said bristle ends form a uniform bristle end distribution throughout said bristle portion, wherein said bristle portion has a filament density of approximately 45 to approximately 60 filaments for each of said plurality of helical turns; and at least some of said plurality of filaments having a central core with a plurality of spaced apart and radially extending flanges, wherein at least one of said plurality of flanges is bent in a direction different from one or more of the other flanges, the central core having a periphery, and said periphery between adjacent flanges holding said mascara by surface tension.

14. The applicator according to claim 13, wherein said plurality of filaments are each made of plastic.

15. The applicator according to claim 13, wherein said filament density is approximately 45 to approximately 55 filaments for each of said plurality of helical turns.

16. The applicator according to claim 13, wherein said plurality of flanges includes at least two approximately identical flanges that radially extend from said central core in approximately opposite directions.

17. The applicator according to claim 2, wherein said plurality of flanges includes at least two approximately identical flanges that radially extend from said central core in approximately opposite directions.

18. An applicator for applying liquid material to a portion of one's body, said applicator comprising:

a core twisted together to form a plurality of helical turns;

a bristle portion formed of a plurality of filaments, each of said plurality of filaments being crimped medially by said core to form bristle ends that flare outwardly from said core, wherein said bristle ends form a uniform bristle end distribution throughout said bristle portion, wherein said bristle portion has a filament density of approximately 45 to approximately 60 filaments for each of said plurality of helical turns; and at least some of said plurality of filaments having a central core with a plurality of spaced apart and radially extending flanges, at least one of said plurality of flanges having an approximate cross-section from the group consisting of T-shaped and cruciform shaped, wherein the central core has a periphery, and wherein said periphery between adjacent flanges holds said liquid material by surface tension.

19. The applicator according to claim 18, wherein said central core is hollow.

* * * * *